US007086102B1

(12) United States Patent
Frazier

(10) Patent No.: US 7,086,102 B1
(45) Date of Patent: Aug. 8, 2006

(54) UNITIZED BEDCLOTHES ASSEMBLY

(76) Inventor: Robert Frazier, 1111 Worley Rd., Suisun, CA (US) 94585

( * ) Notice: Subject to any disclaimer, the term of this patent is extended or adjusted under 35 U.S.C. 154(b) by 0 days.

(21) Appl. No.: 10/335,304

(22) Filed: Dec. 30, 2002

(51) Int. Cl.
*A47G 9/02* (2006.01)

(52) U.S. Cl. ..... 5/502; 5/497; 5/494

(58) Field of Classification Search ..... 5/482, 5/494, 496, 497, 498, 502
See application file for complete search history.

(56) References Cited

U.S. PATENT DOCUMENTS 3,857,124 A * 12/1974 Hadley ..... 5/496
4,161,044 A * 7/1979 Bogle ..... 5/494
4,266,308 A * 5/1981 Shatz ..... 5/494
4,546,508 A * 10/1985 Ison ..... 5/494
4,964,184 A * 10/1990 Lewis ..... 5/496
5,084,929 A * 2/1992 Staudinger ..... 5/494
5,729,847 A * 3/1998 Allardice ..... 5/502
6,098,219 A * 8/2000 Milber ..... 5/494

* cited by examiner

*Primary Examiner*—Michael F. Trettel
(74) *Attorney, Agent, or Firm*—Harris Zimmerman

(57) ABSTRACT

A unitized bedclothes assembly simplifies bed making operations and prevents loosening and disarrangement of bed coverings while a person is sleeping and when the bed is unoccupied. Elastic bands clasp a fitted sheet to an underlying mattress. A fabric top covering is permanently fastened to the fitted sheet at the foot region of the bedclothes assembly. Fastener elements extend along at least one side of the top covering and are selectively engageable with additional fastener elements which extend along the corresponding side of the fitted sheet. The top covering has skirt flaps which hang down at opposite sides of the bedclothes assembly and give the assembly the neat appearance of a bed which has been made in the traditional manner.

6 Claims, 3 Drawing Sheets

UNITIZED BEDCLOTHES ASSEMBLY

CROSS-REFERENCE TO RELATED APPLICATION (Not Applicable)

STATEMENT REGARDING FEDERALLY SPONSORED RESEARCH OR DEVELOPMENT (Not Applicable)

BACKGROUND OF THE INVENTION

This invention relates to bed coverings for disposition on a mattress or the like.

Traditional bedclothes include bed sheets, one or more blankets and a bedspread which are separate sheets of fabric that are placed on a mattress. Making of the bed after each use requires that the bed coverings be rearranged and that margins of the sheets and blankets be tucked under edges of the mattress. The bedspread is draped over the rearranged bedding to give the bed a neat and attractive appearance. Making the traditional bed in this manner can be a somewhat time consuming and bothersome operation.

The traditional bed coverings are not securely held in place and can be easily disarranged by movements of a sleeping person or by activities which occur when the bed is not in use. Many persons do not sleep comfortably if the bed clothes have become disarranged. A bed can present an unattractive appearance if the bedclothes become disarrayed when the bed is not in use.

Bed coverings need to be washed or otherwise cleaned at frequent intervals and at times may be folded and put away for storage. Individual handling of separate sheets, blankets and bedspreads for these purposes complicates such operations.

The above discussed problems can be particularly pronounced in various specific situations. For example, the present invention was initially designed for use by truck drivers who make long distance hauls. Large trucks or big rigs which are used for this purpose frequently have a sleeping compartment or bunk built into the cab of the vehicle. Freight must usually be transported with a minimum of delay. Time spent making a bed after a period of sleep or rest detracts from this objective. It is highly important that the truck driver obtain an adequate amount of sleep and loose bed coverings may interfere with this.

A need for simplifying the making of beds and for resisting disarrangement of bed coverings is by no means confined to sleeping bunks in trucks. The problems discussed above are present in various other contexts ranging from military barracks to homeless shelters to penal institutions. As a practical matter these needs are also present in many modern households. Employed persons, students and others may not take the time to make their beds before leaving their homes. They must then make the bed when they arrive home or sleep in an unmade bed.

The present invention is directed to overcoming one or more of the problems discussed above.

BRIEF SUMMARY OF THE INVENTION

In one aspect the present invention provides unitized bedclothes which include a fitted sheet formed of fabric. The fitted sheet has a horizontally extending area shaped to overlay a mattress and has side portions and end portions formed to extend downward along opposite sides and opposite ends of the mattress. Strips of elastic material are each attached to a separate lower corner of the fitted sheet in position to extend under an adjacent corner of the mattress and thereby clasp the fitted sheet to the mattress. A fabric top covering has a horizontal upper portion shaped to overlay the horizontally extending area of the fitted sheet. The top covering has skirt flaps which extend along opposite sides of the horizontal upper portion of the covering in position to hang downward at opposite sides of the fitted sheet and mattress. The top covering is permanently fastened to the fitted sheet at a foot end region of the bedclothes assembly. First fastener elements extend along at least one side of the upper portion of the top covering and are selectively engagable with second fastener elements which extend along a corresponding side of the horizontally extending area of the fitted sheet.

In another aspect, the invention provides a unitized bedclothes assembly which includes a fabric fitted sheet having a horizontal area and vertical side portions and end portions formed to extend downward along opposite sides and opposite ends of a mattress. A plurality of strips of stretchable elastic material each extend around a separate lower corner of the fitted sheet and are attached to the side portions and end portions in position to be fitted under an adjacent corner of the mattress and thereby clasp the sheet to the mattress. A fabric top covering has a multi-layered upper portion which overlays the horizontal area of the fitted sheet and which conforms in outline with the horizontal area of the fitted sheet. The top covering has skirt flaps extending along opposite sides of the upper portion in position to hang downward at opposite sides of the fitted sheet and mattress and thereby conceal the sides of the sheet and mattress when the bedclothes assembly is unoccupied, the skirt flaps being extensions of an uppermost layer of the multi-layered upper portion of the top covering. The upper portion of the top covering is permanently fastened to the fitted sheet at a foot end region of the bedclothes assembly. First fastener elements extend along at least one side of the upper portion of the top covering and are selectively engagable with second fastener elements which extend along a corresponding side of the horizontal area of the fitted sheet.

The invention provides a unitized assembly of bedclothes which clasps an underlying mattress or the like. The assembly includes a fitted sheet and a fabric top covering which are permanently fastened to each other at least at a foot region of the bedclothes and which are fastened together along at least one side of the assembly by fastening means which can be engaged and disengaged to enable entry and exit of a person. Engagement of the fastening means prevents disarrangement of the bedclothes while a person is sleeping and also when the bed is unoccupied. Skirt flaps along the sides of the top covering extend downward at the sides of the mattress and give the unoccupied bedclothes assembly the neat appearance of a bed which has been made in the traditional manner.

The invention, together with further objects and advantages thereof, may be further understood by reference to the following detailed description of the invention and by reference to the accompanying drawings.

DETAILED DESCRIPTION OF THE INVENTION

Figure 1:
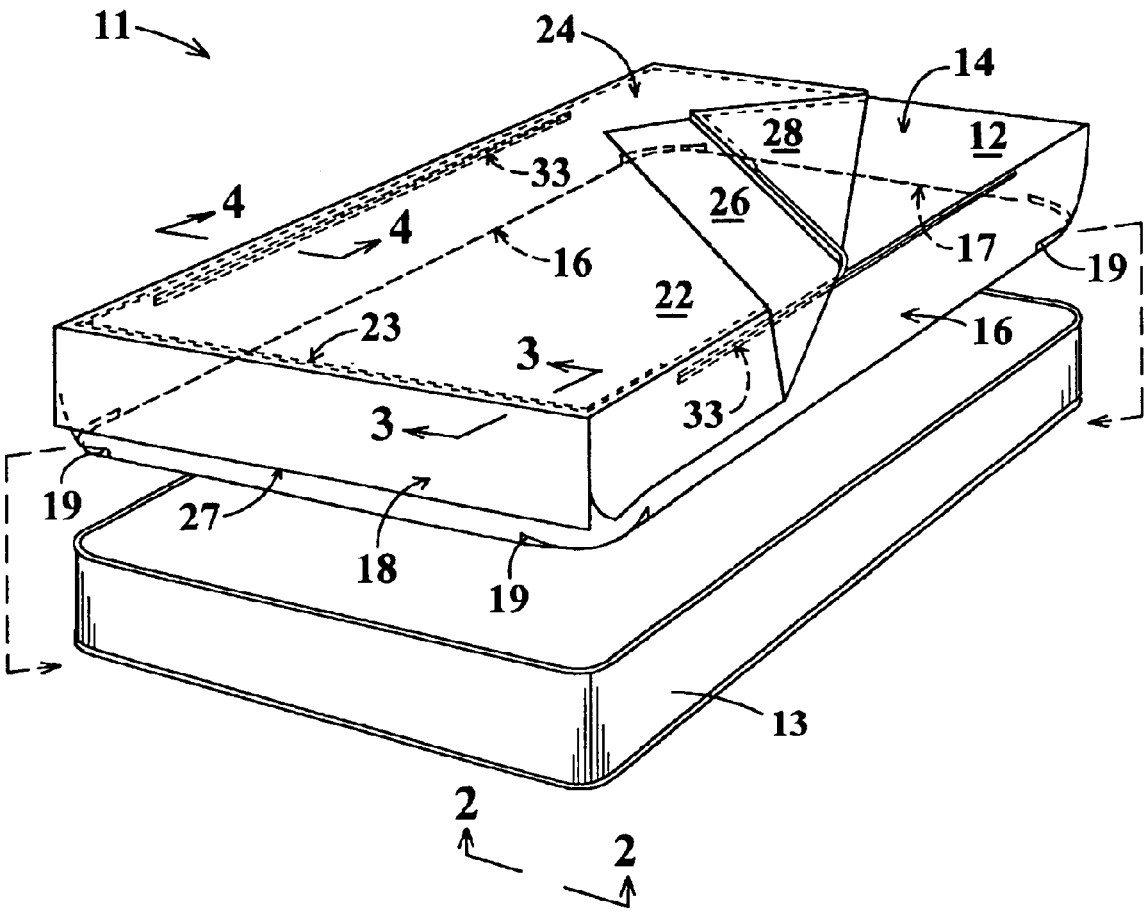
FIG. 1 is a perspective view of a unitized bedclothes assembly embodying the invention as it appears prior to installation on a mattress.

Referring initially to FIG. 1 of the drawings, a unitized bedclothes assembly 11 in accordance with a preferred embodiment of the invention includes a fabric sheet 12 adapted to be fitted onto and to clasp a mattress 13 or other padding which serves as a mattress. Sheet 12 has an inverted box like configuration which substantially conforms to the shape of the mattress 11. In particular, a horizontally extending area 14 of the sheet 12 directly overlays the top surface of mattress 13 and is bounded by side portions 16 and head end and foot end portions 17 and 18, respectively, which extend downward for disposition against the sides and ends of the mattress.

Figure 2:
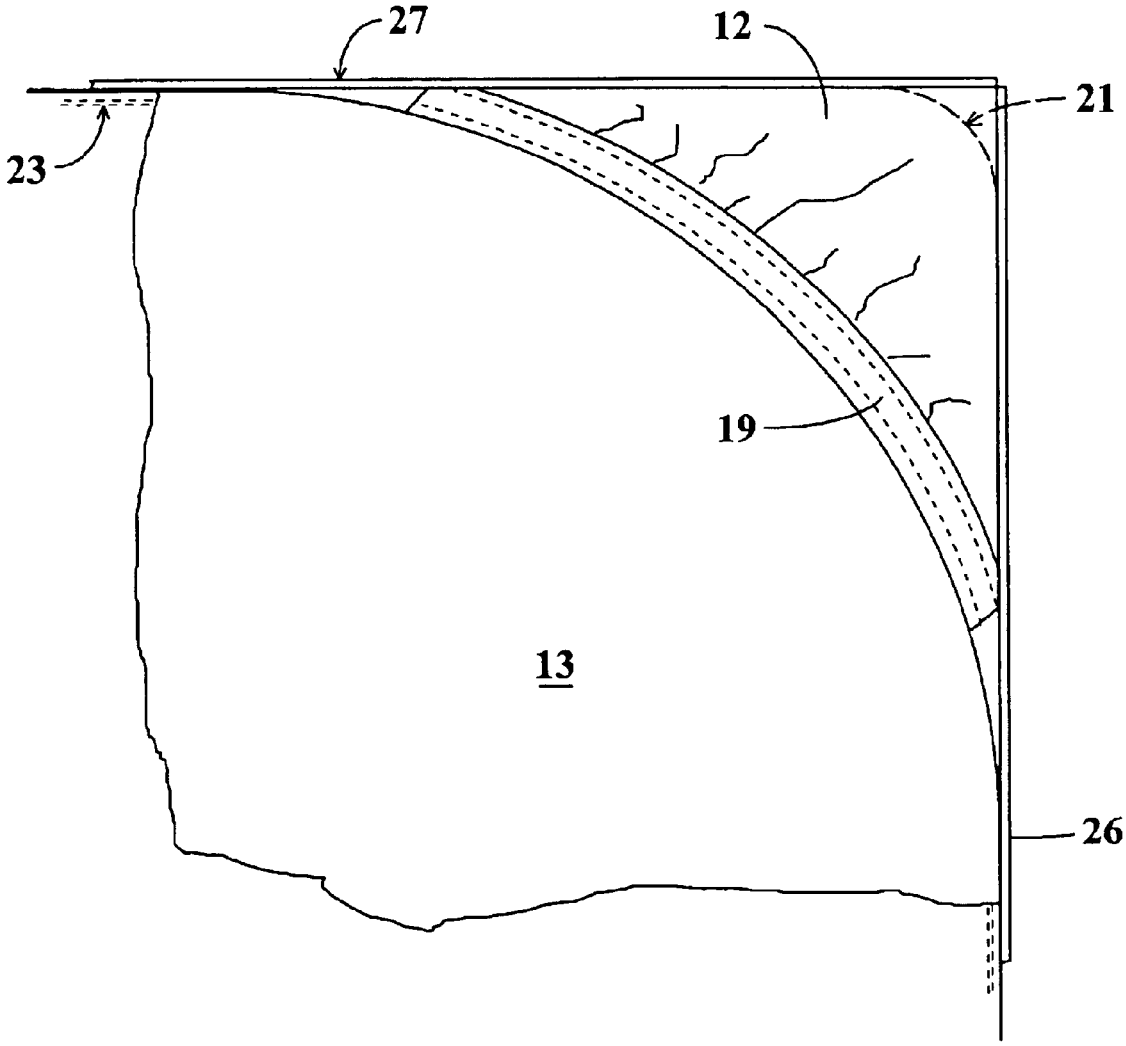
FIG. 2, taken along line 2—2 of FIG. 1, depicts the underside of a corner region of the bedclothes assembly following installation of the assembly on the mattress.

Referring jointly to FIGS. 1 and 2, elastic strips 19 are stitched or otherwise fastened to the edges of sheet 12 at the lower corners of the sheet and extend around the corners. Strips 19 are temporarily tensioned by stretching during the stitching process. When the tension is released, the strips 19 shorten and draw the lower corner regions of the sheet 12 inward towards the center of the sheet. The strips 19 may be manually stretched in order to fit the corners of sheet 12 onto the corners 21 of mattress 13. The strips 19 then extend under the mattress corners 21 and clasp the sheet 12 to the mattress.

Figure 3:
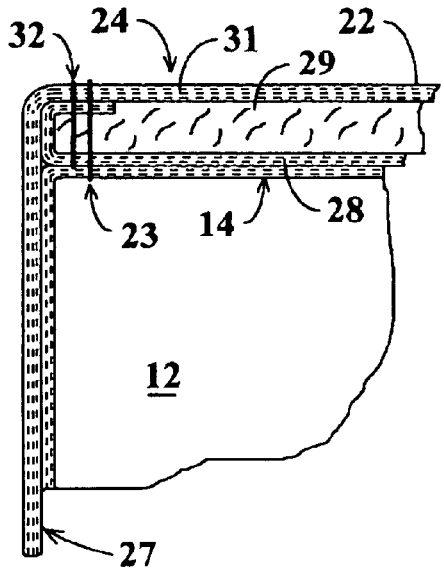
FIG. 3 is a section view of a foot end region of the bedclothes assembly taken along line 3—3 of FIG. 1.

Referring to FIGS. 1 and 3, a fabric top covering 22 is permanently fastened to the sheet 12 by stitching 23 at the foot end region 18 of the bedclothes assembly 11. In this example the stitching 23 also extends a short distance towards the head end region 17 along the sides of the horizontal area of the bedclothes assembly 11. Top covering 22 has a horizontal upper portion 24 which overlays the horizontal area 14 of sheet 12 and which conforms in outline to the horizontal area of the sheet. The top covering 22 also has skirt flaps 26 extending along opposite sides of the upper portion 24 and which hang down to cover the sides of sheet 12 and mattress 13 when the bedclothes assembly is fitted onto the mattress. Surfaces of the top covering 22 including surfaces of skirt flaps 26 which are visible from the exterior of the bed create the appearance of a decorative bedspread and, if desired, may be provided with designs or patterning (not shown) which enhance this appearance. An additional downward hanging skirt flap 27 may be provided at the foot end of top covering 22 in instances where the foot end of sheet 12 would otherwise be visible.

Referring to FIG. 3 in particular, the top covering 22 may be formed of a single layer of fabric but preferably has a multi-layered construction to provide for warmth of a sleeping person. In this particular example, the horizontally extending upper portion 24 of top covering 22 has a lower fabric layer 28 of material which may be similar to that of sheet 12, an intermediate layer 29 of blanketing material which is relatively thick and an upper fabric layer 31 which presents the appearance of a bedspread. Edges of the layers 28, 29 and 31 are permanently secured together by stitching 32 or the like which extends around the perimeter of the horizontal portion 24 of the top covering 22. Skirt flaps 26 and 27 in this example are extensions of the material of the upper fabric layer 31.

Figure 4:
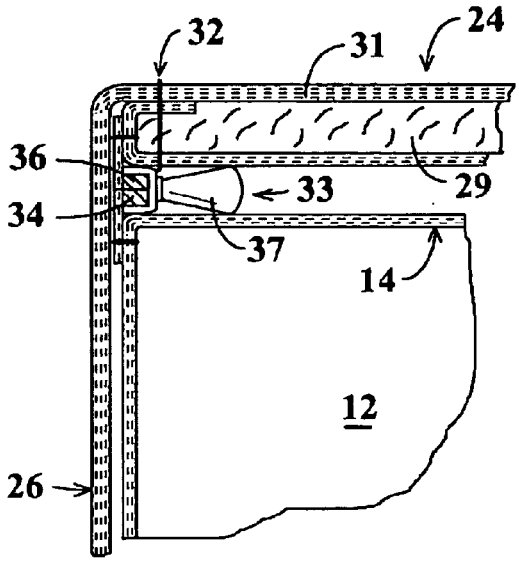
FIG. 4 is a cross section view of a side portion of the bedclothes assembly taken along line 4—4 of FIG. 1.

Referring to FIGS. 1 and 4, fastening means 33 which can be engaged and disengaged extend along at least one side of the horizontal area of sheet 12 and top covering 22 between the head end of the bedclothes assembly and the previously described stitching 23 at the foot end of the assembly. As here shown, fastening means 33 are provided along both sides. The fastening means 33 includes a first set of fastener elements 34 which are attached to sheet 12 and a second set of fastener elements 36 which are attached to top covering 22. The fastener elements 33 and 34 of this example are components of a slide fastener or Zipper™ of the known type which are selectively engaged and disengaged by linear movement of a slider 37. Alternately, the fastening means can be of the snap type or be hook and loop fastener tapes of the Velcro™ type. The fastener elements 33 and 34 are located at the top of sheet 12 in order to be easily operable by a person who is within the bed. The fastening means can be operated by a person who is not in the bed by lifting skirts 26.

Fastening means 33 can be disengaged at one or both sides of the bedclothes assembly 11 to enable easy entry into and exit from the bed. Reengagement of the fastening means 33 after entry assures that the bed coverings do not become loosened and disarranged while the bed is occupied.

The fastening means 33 can be quickly reengaged after exiting from the bed to impart a trim made up appearance to the bed and to assure that it remains in that condition while it is unoccupied. The unitized bedclothes assembly 11 also simplifies other operations which traditionally require individual handling of separated sheets, blankets and bedspreads. For example, the unitized assembly may be quickly fitted onto a mattress and may be quickly removed for cleaning or storage.

Figure 5:
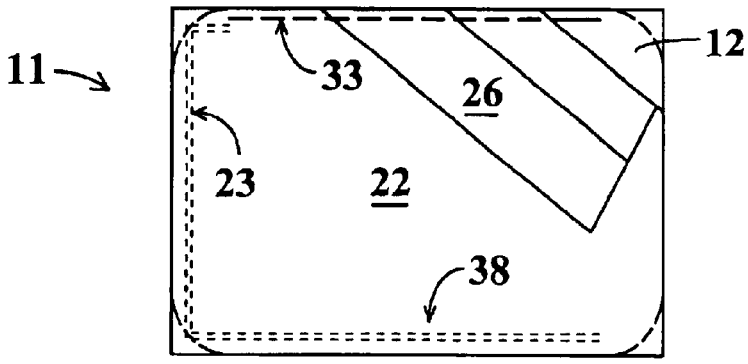
FIG. 5 is a top view of a second embodiment of the bedclothes assembly.

Referring to FIG. 5, the fastening means 33 may extend along only one side of the bedclothes assembly 11 in which case the sheet 12 and top covering 22 are permanently fastened together along the other side by additional stitching 38. This construction is appropriate where the bedclothes assembly 11 is proportioned for a single person and will always be accessed from the same side.

While the invention has been described with reference to certain specific embodiments for purposes of example, many modifications and variations are possible and it is not intended to limit the invention except as defined by the following claims.

What is claimed is:

1. Unitized bedclothes for disposition on a mattress comprising:

a fitted sheet formed of fabric and having a horizontally extending area shaped to overlay said mattress and having side portions and end portions formed to extend downward along opposite sides and opposite ends of said mattress;

a plurality of strips of elastic material each being attached to a separate lower corner of said fitted sheet in position to extend under an adjacent corner of said mattress and thereby clasp said fitted sheet to said mattress;

a fabric top covering having a horizontal upper portion shaped to overlap said horizontally extending area of said fitted sheet, said top covering having skirt flaps extending along opposite sides of said upper portion in position to hang downward at opposite sides of said fitted sheet and mattress, said top covering being permanently fastened to said fitted sheet at a foot end region of the bedclothes assembly; and first fastener elements extending along at least one side of said upper portion of said top covering and being selectively engagable with second fastener elements which extend along a corresponding side of said horizontally extending area of said fitted sheet;

said top covering includes a plurality of layers of fabric which are permanently fastened together at edges of said upper portion of said top covering, said skirt flaps being extensions of an uppermost one of said layers of fabric.

2. The bedclothes assembly of claim 1 wherein said layers of fabric of said top covering include a layer of blanketing material having an outline conforming to said upper portion of said top covering.

3. The bedclothes assembly of claim 1 wherein said plurality of layers of fabric of said top covering are permanently fastened together by stitching which extends around the perimeter of said upper portion of said top covering.

4. Unitized bedclothes for disposition on a mattress comprising:

a fitted sheet formed of fabric and having a horizontally extending area shaped to overlay said mattress and having side portions and end portions formed to extend downward along opposite sides and opposite ends of said mattress;

a plurality of strips of elastic material each being attached to a separate lower corner of said fitted sheet in position to extend under an adjacent corner of said mattress and thereby clasp said fitted sheet to said mattress;

a fabric top covering having a horizontal upper portion shaped to overlay said horizontally extending area of said fitted sheet, said top covering having skirt flaps extending along opposite sides of said upper portion in position to hang downward at opposite sides of said fitted sheet and mattress, said top covering being permanently fastened to said fitted sheet at a foot end region of the bedclothes assembly; and first fastener elements extending along at least one side of said upper portion of said top covering and being selectively engagable with second fastener elements which extend along a corresponding side of said horizontally extending area of said fitted sheet;

wherein a single set of said first and second fastener elements extends along one side of said horizontal upper portion of said top covering and wherein said top covering is permanently fastened to said horizontally extending area of said fitted sheet along an opposition side thereof.

5. A bedclothes assembly comprising:

a fabric fitted sheet having a horizontal area and vertical side portions and end portions formed to extend downward along opposite sides and opposite ends of a mattress;

a plurality of strips of stretchable elastic material each extending around a separate lower corner of said fitted sheet and being attached thereto in position to be fitted under an adjacent corner of said mattress and thereby clasp said fitted sheet to said mattress;

a fabric top covering having a multi-layered upper portion which overlays said horizontal area of said fitted sheet and which conforms in outline with said horizontal area of said fitted sheet, said top covering having skirt flaps extending along opposite sides of said upper portion in position to hang downward at opposite sides of said fitted sheet and mattress and thereby conceal said sides of said fitted sheet and mattress when the bedclothes assembly is unoccupied, said skirt flaps being extensions of an uppermost layer of said multi-layered upper portion of said top covering, said upper portion of said top covering being permanently fastened to said fitted sheet at a foot end region of the bedclothes assembly; and first fastener elements extending along at least one side of said upper portion of said top covering and being selectively engagable with second fastener elements which extend along a corresponding side of said horizontal area of said fitted sheet.

6. The bedclothes assembly of claim 5 wherein layers of said multi-layered upper portion are secured togather by stitching which extends around edges of said multi-layered upper portion and wherein said upper portion of said top covering is permanently fastened to said fitted sheet at said foot end region of the bedclothes assembly by stitching which extends across said foot end region of said bedclothes assembly.

* * * * *